US009989912B2

(12) United States Patent
Ohata

(10) Patent No.: US 9,989,912 B2
(45) Date of Patent: Jun. 5, 2018

(54) IMAGE FORMING APPARATUS

(71) Applicant: KYOCERA Document Solutions Inc., Osaka (JP)

(72) Inventor: Shinobu Ohata, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days. days.

(21) Appl. No.: 15/508,999

(22) PCT Filed: Oct. 2, 2015

(86) PCT No.: PCT/JP2015/078018
§ 371 (c)(1),
(2) Date: Mar. 6, 2017

(87) PCT Pub. No.: WO2016/056474
PCT Pub. Date: Apr. 14, 2016

(65) Prior Publication Data

US 2017/0277112 A1 Sep. 28, 2017

(30) Foreign Application Priority Data

Oct. 7, 2014 (JP) ..... 2014-206610

(51) Int. Cl.
*G03G 15/00* (2006.01)

(52) U.S. Cl.
CPC ..... *G03G 15/80* (2013.01)

(58) Field of Classification Search
CPC ..... G03G 15/80
See application file for complete search history.

(56) References Cited

U.S. PATENT DOCUMENTS

2003/0156854 A1* 8/2003 Sugita ..... G03G 15/80 399/90
2006/0291893 A1* 12/2006 Yano ..... G03G 15/80 399/90

FOREIGN PATENT DOCUMENTS

JP 2013-250326 A 12/2013
WO 2016/056474 A1 4/2016

* cited by examiner

*Primary Examiner* — Clayton E Laballe
*Assistant Examiner* — Jas Sanghera
(74) *Attorney, Agent, or Firm* — Studebaker & Brackett PC

(57) ABSTRACT

An image forming apparatus of the present invention includes a unit (18), a high-voltage board (36), a connecting member (43) and a holding member (44). The connecting member (43) is arranged in a current path from the high-voltage board (36) to the unit (18). The holding member (44) holds the connecting member (43). The connecting member (43) includes a spring terminal (68) and a protruding part (69). The protruding part (69) protrudes from the spring terminal (68) to an outer diameter side. The holding member (44) includes a housing (83) and a locking part (91). The housing (83) houses the spring terminal (68). The locking part (91) is arranged integrally with the housing (83). When the locking part (91) locks the protruding part (69), movement of the spring terminal (68) in an axial center direction is restricted.

13 Claims, 9 Drawing Sheets

IMAGE FORMING APPARATUS

TECHNICAL FIELD

The present invention relates to an electrographic image forming apparatus.

BACKGROUND ART

Conventionally, an electrographic image forming apparatus includes various units, such as a photosensitive drum unit, a developing unit and a transferring unit. These units are used for an image forming process on a recording medium.

For example, an image forming apparatus, which includes a unit used for an image forming process on a recording medium, a high-voltage board supplying a high-voltage current to the unit, a connecting member connecting the high-voltage board and the unit, and a holding member holding the connecting member, is known (refer to Patent Document 1).

PRIOR ART DOCUMENT

Patent Document

[Patent Document 1] Japanese patent laid-open publication No. 2013-250326

SUMMARY OF INVENTION

Technical Problem

In the image forming apparatus configured as mentioned above, there is a case that a spring terminal arranged in the connecting member is housed in a housing arranged in the holding member. However, if the spring terminal is simply housed in the housing, it is feared that the spring terminal comes off the housing and the spring terminal is displaced with respect to the housing, during assembly of the connecting member to the holding member, maintenance of the image forming apparatus or the like.

On the other hand, in order to restrain coming-off of the spring terminal from the hosing and displacement of the spring terminal with respect to the housing, if a coming-off prevention member (e.g. a coming-off prevention cap) separate from the connecting member and the holding member is provided, the number of components is increased and a configuration of the image forming apparatus is complicated.

An object of the present invention is, under consideration of the above-mentioned circumstances, to restrain coming-off of the spring terminal from the hosing and displacement of the spring terminal with respect to the housing by simple structure.

Solution to Problem

An image forming apparatus of the present invention includes a unit, a high-voltage board, a connecting member and a holding member. The unit is used for an image forming process on a recording medium. The high-voltage board supplies a high-voltage current to the unit. The connecting member is arranged in a current path from the high-voltage board to the unit. The holding member holds the connecting member. The connecting member includes a spring terminal and a protruding part. The spring terminal is composed of a coil spring. The protruding part protrudes from the spring terminal to an outer diameter side. The holding member includes a housing and a locking part. The housing houses the spring terminal. The locking part is arranged integrally with the housing. When the locking part locks the protruding part, movement of the spring terminal in an axial center direction is restricted.

Advantageous Effects of Invention

In accordance with the invention, it is possible to restrain coming-off of the spring terminal from the hosing and displacement of the spring terminal with respect to the housing by simple structure.

DESCRIPTION OF EMBODIMENTS

Figure 1:
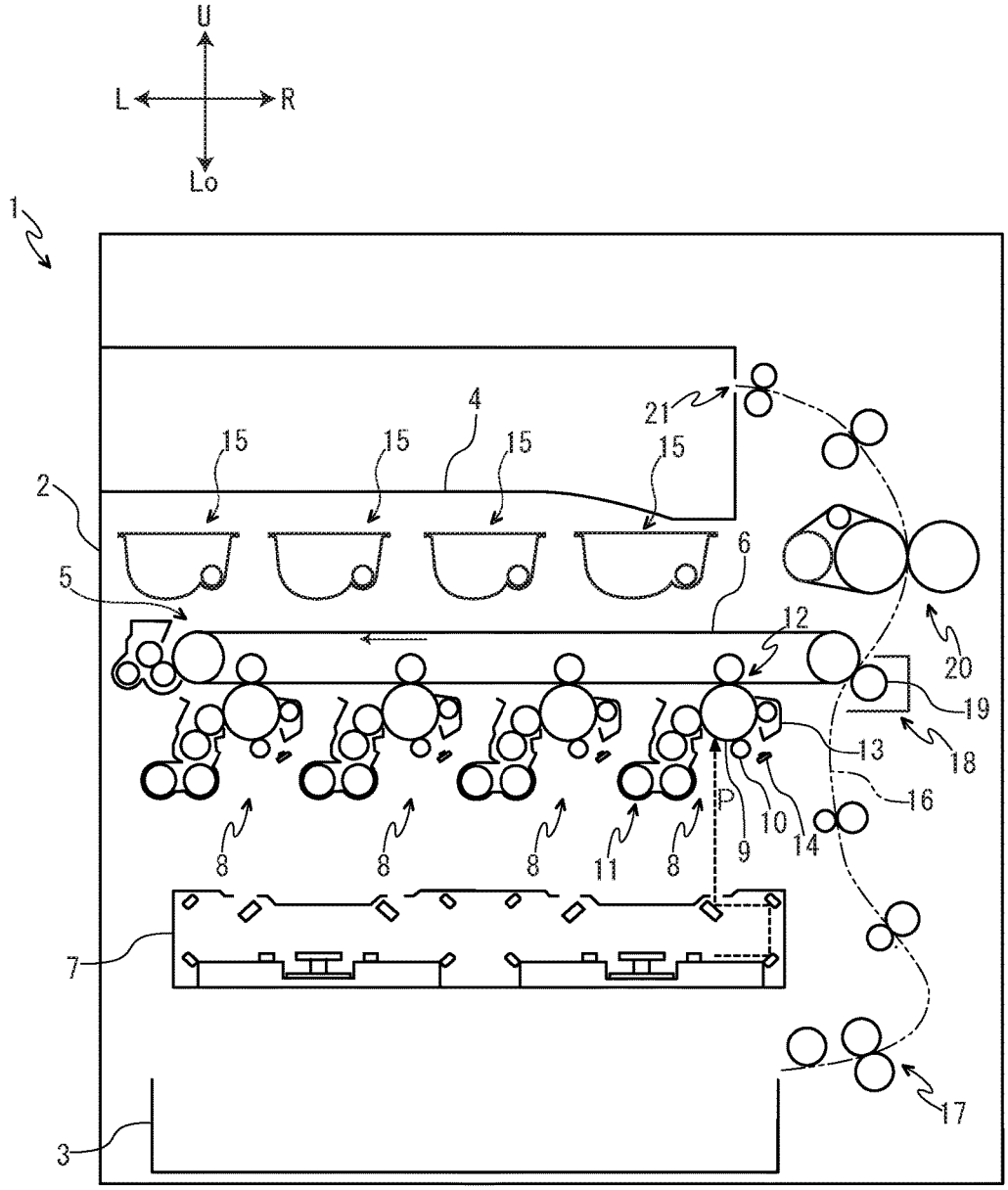
FIG. 1 is a schematic diagram showing an outline of a configuration of a color printer according to an embodiment of the present invention.

Firstly, with reference to FIG. 1, the entire structure of a color printer 1 (image forming apparatus) will be described. Hereinafter, a near side of FIG. 1 will be described as a front side of the color printer 1, for convenience of explanation. Arrows Fr, Rr, L, R, U and Lo on each figure indicate a front side, a rear side, a left side, a right side, an upper side and a lower side of the color printer 1, respectively.

The color printer 1 includes a box-formed printer main body 2 (apparatus main body). In a lower part of the printer main body 2, a sheet feeding cartridge 3 storing a sheet (recording medium) is arranged. In an upper part of the printer main body 2, an ejected sheet tray 4 is arranged.

In a middle part of the printer main body 2, an intermediate transferring unit 5 is arranged. The intermediate transferring unit 5 is provided with an intermediate transferring belt 6 (image carrier) disposed around a plurality of rollers.

Below the intermediate transferring belt 6, an exposure device 7 composed of a laser scanning unit (LSU) is arranged. At a lower side of the intermediate transferring belt 6, four image forming parts 8 are arranged for respective colors (e.g. four colors of magenta, cyan, yellow and black) of toners. In each image forming part 8, a photosensitive drum 9 is rotatably arranged. Around the photosensitive drum 9, a charger 10, a developing device 11, a primary transferring part 12, a cleaning device 13 and a static eliminator 14 are located in order of primary transferring processes. Above the developing device 11, toner containers 15 corresponding to the respective image forming parts 8 are arranged for the respective colors (e.g. four colors of magenta, cyan, yellow and black) of the toners.

At a right side part of the printer main body 2, a conveying path 16 for the sheet is arranged in upper and lower direction. At an upstream end of the conveying path 16, a sheet feeding part 17 is arranged. At an intermediate stream part of the conveying path 16, a secondary transferring unit 18 (unit) is arranged at a right end side of the intermediate transferring belt 6. The secondary transferring unit 18 includes a secondary transferring roller 19. At a downstream part of the conveying path 16, a fixing device 20 is arranged. At a downstream end of the conveying path 16, a sheet ejection port 21 is arranged.

Next, an image forming process on the sheet in the color printer 1 having such a configuration will be described.

When the power is supplied to the color printer 1, various parameters are initialized and initial determination, such as temperature determination of the fixing device 20, is carried out. Subsequently, when image data is inputted and a printing start is directed from a computer or the like connected with the color printer 1, the image forming process on the sheet is carried out as follows.

Firstly, the surface of the photosensitive drum 9 is electrically charged by the charger 10. Then, an electrostatic latent image is formed on the surface of the photosensitive drum 9 by a laser light (refer to an arrow P) from the exposure device 7. The electrostatic latent image is developed to a toner image in the developing device 11 by the toner supplied from each toner container 15. The toner image is primarily transferred to the surface of the intermediate transferring belt 6 in the primary transferring part 12. The above-mentioned operation is repeated in order by the respective image forming parts 8, thereby forming the toner image of full color on the intermediate transferring belt 6. Incidentally, toner and electric charge remained on the photosensitive drum 9 are removed by the cleaning device 13 and the static eliminator 14.

On the other hand, the sheet fed from the sheet feeding cartridge 3 or a manual bypass tray (not shown) by the sheet feeding part 17 is conveyed to the secondary transferring unit 18. Then, by the secondary transferring roller 19 of the secondary transferring unit 18, the toner image of full color on the intermediate transferring belt 6 is secondary transferred to the sheet. The sheet with the secondary transferred toner image is conveyed to a downstream side on the conveying path 16 to enter the fixing device 20, and then, the toner image is fixed on the sheet in the fixing device 20. The sheet with the fixed toner image is ejected from the sheet ejection port 21 on the ejected sheet tray 4.

Next, the printer main body 2 will be further described.

Figure 2:
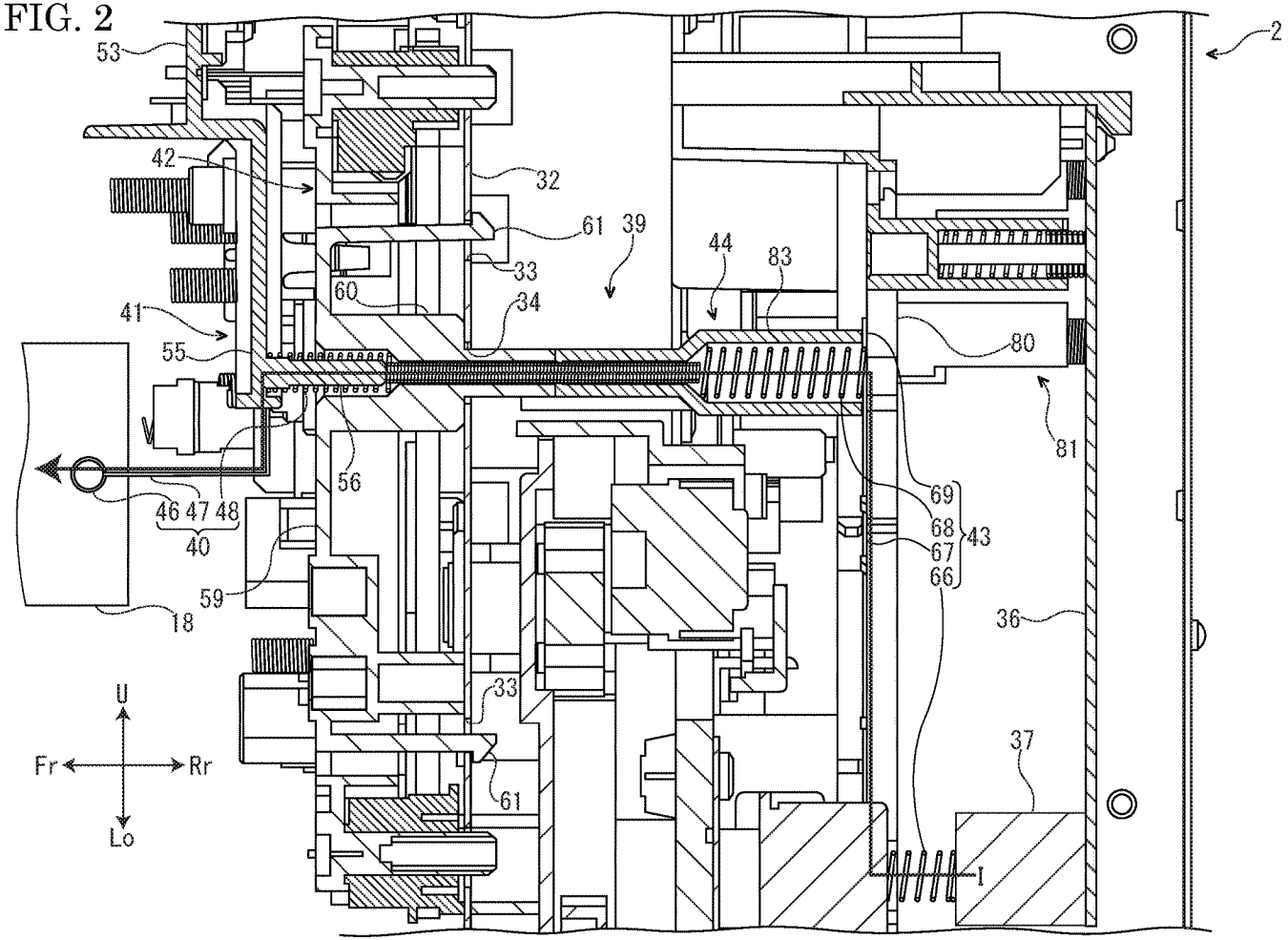
FIG. 2 is a sectional view showing a connecting mechanism and its periphery, in the color printer according to the embodiment of the present invention.

As shown in FIG. 2, at a rear part of the printer main body 2, a rear side frame 32 is set up. The rear side frame 32 is provided with a pair of upper and lower hook holes 33, and, below the upper hook hole 33, a through hole 34 is formed.

Next, a high-voltage board 36 disposed in the printer main body 2 will be described.

As shown in FIG. 2, the high-voltage board 36 is set up at a rear side of the rear side frame 32 of the printer main body 2. The high-voltage board 36 is connected with a power supply board (not shown) connected to an external power supply. At a lower end of the high-voltage board 36, a secondary transferring transformer 37 is provided.

Next, a connecting mechanism 39 electrically connecting the high-voltage board 36 and the secondary transferring unit 18 will be described.

As shown in FIG. 2, the connecting mechanism 39 includes a first connecting member 40 (another connecting member), a first holding member 41 holding the first connecting member 40, a coupling member 42 arranged at a rear side of the first holding member 41, a second connecting member 43 (connecting member) arranged at a rear side of the first connecting member 40, and a second holding member 44 (holding member) holding the second connecting member 43.

The first connecting member 40 is formed of a conductive metal wire, for example. As shown in FIG. 2, the first connecting member 40 includes a unit-side spring terminal 46, a first spring terminal 48 arranged at a rear side of the unit-side spring terminal 46, and a first conductive wire 47 connecting the unit-side spring terminal 46 and the first spring terminal 48.

The unit-side spring terminal 46 is composed of a compressible coil spring. The unit-side spring terminal is elongated in left and right direction (a depth direction in FIG. 2). The unit-side spring terminal 46 is in contact with the secondary transferring unit 18.

Figure 3:
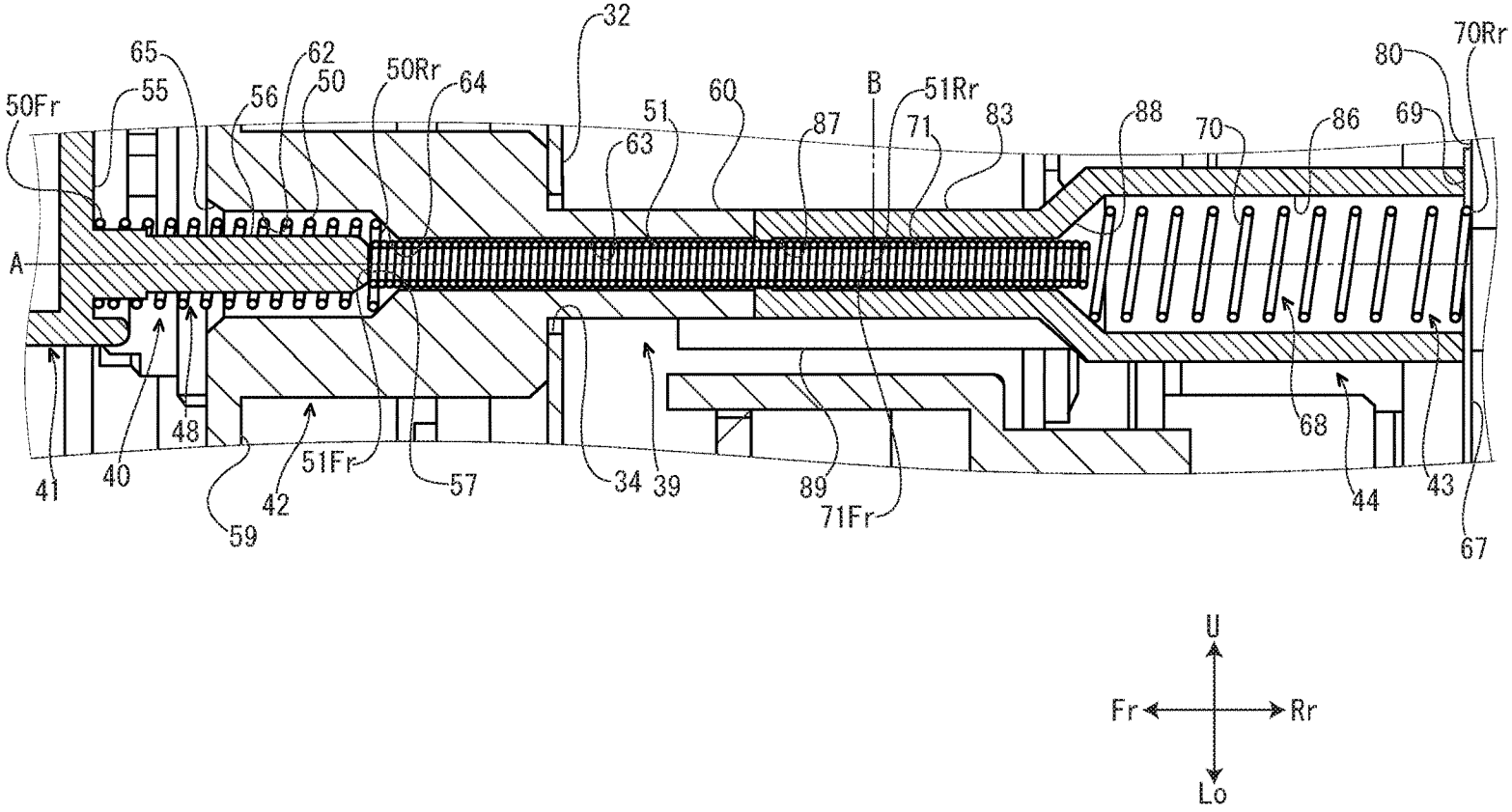
FIG. 3 is a sectional view showing first and second spring terminals and their periphery, in the color printer according to the embodiment of the present invention.

As shown in FIG. 3 and others, the first spring terminal 48 is provided around an axial center A elongated in the front and rear direction. That is, in the present embodiment, an axial center direction of the first spring terminal 48 is the front and rear direction. The first spring terminal 48 includes a first large diameter portion 50 and a first small diameter portion 51. The first small diameter portion 51 is provided at a rear side of the first large diameter portion 50 to continue to the first large diameter portion 50. The first large diameter portion 50 is composed of an untightly wound coil spring (a coil spring having winding parts separated from each other), and is compressible in the front and rear direction. The first small diameter portion 51 is composed of a tightly wound coil spring (a coil spring having winding parts being in contact with each other), and is not compressible in the front and rear direction. The first small diameter portion 51 has an outer diameter smaller than the first large diameter portion 50.

The first holding member 41 is made of a resin having a high electrical insulation property, for example. As shown in FIG. 2, the first holding member 41 includes a first holding member main body 53, a holding plate part 55 extending downward from the first holding member main body 53 along the upper and lower direction, and a boss part 56 extending backward from a lower end of the holding plate part 55 along the front and rear direction.

As shown in FIG. 3, a front end 50Fr of the first large diameter portion 50 of the first spring terminal 48 comes into contact with the holding plate part 55. An outer diameter of the boss part 56 is smaller than an outer diameter of the first large diameter portion 50 of the first spring terminal 48, and is larger than the outer diameter of the first small diameter portion 51 of the first spring terminal 48. To an outer circumference of the boss part 56, the first large diameter portion 50 of the first spring terminal 48 is attached. On a rear end face (distal end face) of the boss part 56, a first small diameter portion contact part 57 is provided. A front end 51Fr of the first small diameter portion 51 of the first spring terminal 48 comes into contact with the first small diameter portion contact part 57.

The coupling member 42 is made of a resin having a high electrical insulation property, for example. As shown in FIG. 2, the coupling member 42 includes a coupling member main body 59, and a cylindrical first housing 60 extending backward from the coupling member main body 59 along the front and rear direction.

The coupling member main body 59 includes a pair of upper and lower hooks 61. Each hook 61 engages with each hook hole 33 provided at the rear side frame 32 of the printer main body 2. Thus, the coupling member 42 is fixed to the rear side frame 32 of the printer main body 2.

The first housing 60 penetrates the through hole 34 formed at the rear side frame 32 of the printer main body 2. As shown in FIG. 3, the first housing 60 includes a first large diameter portion insertion part 62, a first small diameter portion insertion part 63 provided at a rear side of the first large diameter portion insertion part 62, and a first large diameter portion contact part arranged between the first large diameter portion insertion part 62 and the first small diameter portion insertion part 63. In the first large diameter portion insertion part 62, the first large diameter portion 50 of the first spring terminal 48 and the boss part 56 of the first holding member 41 are partially inserted. At a front end of the first large diameter portion insertion part 62, an opening part 65 is formed. In the first small diameter portion insertion part 63, the first small diameter portion 51 of the first spring terminal 48 is partially inserted. The first small diameter portion insertion part 63 has an inner diameter smaller than the first large diameter portion insertion part 62. The first large diameter portion contact part 64 has an inner diameter gradually reduced toward the rear side (toward the side of the first small diameter portion insertion part 63). A rear end 50Rr of the first large diameter portion 50 of the first spring terminal 48 comes into contact with the first large diameter portion contact part 64.

Figure 4:
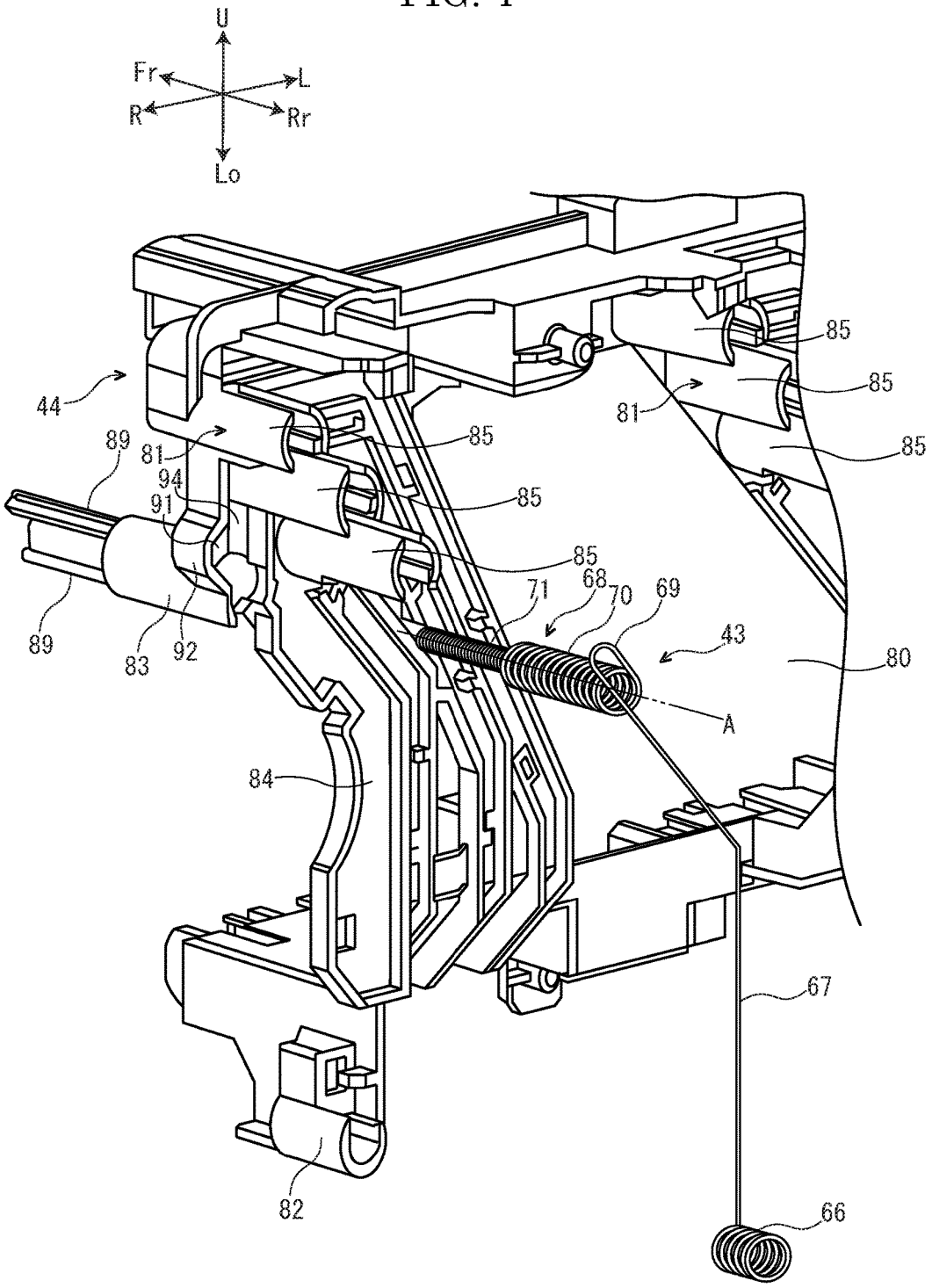
FIG. 4 is an exploded perspective view showing a second connecting member and a second holding member, in the color printer according to the embodiment of the present invention.

The second connecting member 43 is formed of a conductive metal wire, for example. As shown in FIG. 4, the second connecting member 43 includes a board-side spring terminal 66, a second spring terminal 68 (spring terminal) arranged at a front side of the board-side spring terminal 66, a protruding part 69 arranged at a rear upper side of the second spring terminal 68, and a second conductive wire 67 connecting the board-side spring terminal 66 and the protruding part 69.

The board-side spring terminal 66 is composed of a compressible coil spring. The board-side spring terminal 66 extends along the front and rear direction. As shown in FIG. 2, the board-side spring terminal 66 is in contact with the secondary transferring transformer 37 of the high-voltage board 36.

As shown in FIG. 3, similarly to the first spring terminal 48 of the first connecting member 40, the second spring terminal 68 is provided around the axial center A elongated in the front and rear direction. That is, in the present embodiment, an axial center direction of the second spring terminal 68 is the front and rear direction. The second spring terminal 68 is arranged coaxially with the first spring terminal 48. The second spring terminal 68 includes a second large diameter portion 70 (large diameter portion), and a second small diameter portion 71 (small diameter portion). The second small diameter portion 71 is provided at a front side of the second large diameter portion 70 to continue to the second large diameter portion 70. The second large diameter portion 70 is composed of an untightly wound coil spring (a coil spring having winding parts separated from each other), and is compressible in the front and rear direction. The second small diameter portion 71 is composed of a tightly wound coil spring (a coil spring having winding parts being in contact with each other), and is not compressible in the front and rear direction. The second small diameter portion 71 has an outer diameter smaller than the second large diameter portion 70. A front end 71Fr of the second small diameter portion 71 (one end of the second spring terminal 68) is in contact with a rear end 51Rr of the first small diameter portion 51 of the first spring terminal 48. That is, the front end 71Fr of the second small diameter portion 71 composes a high-voltage contact B together with the rear end 51Rr of the first small diameter portion 51 of the first spring terminal 48.

Figure 5:
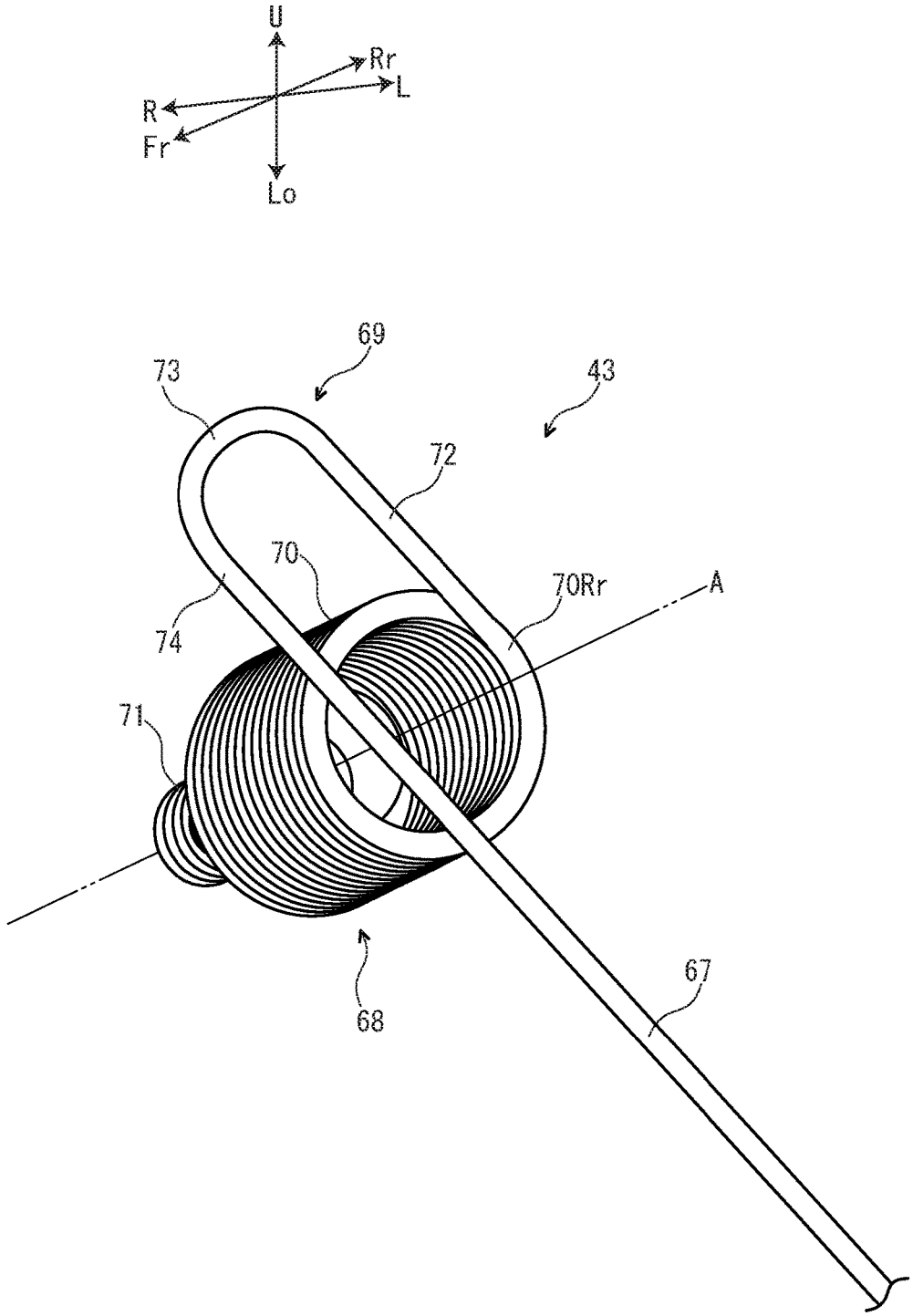
FIG. 5 is a perspective view showing the second connecting member, in the color printer according to the embodiment of the present invention.

As shown in FIG. 5, the protruding part 69 is formed in U-shape. The protruding part 69 protrudes from a rear end 70Rr of the second large diameter portion 70 (opposite end to one end of the second spring terminal 68) toward an outer diameter side. The protruding part 69 includes a first straight line portion 72 extending toward a right upper side from the rear end 70Rr of the second large diameter portion 70 along a tangential direction of the second large diameter portion 70, a bent portion 73 bent in a semicircular shape from a right upper end of the first straight line portion 72, and a second straight line portion 74 extending toward a left lower side from a right lower end of the bent portion 73 along a tangential direction of the bent portion 73. The first straight line portion 72 and the second straight line portion 74 are arranged in parallel to each other. An outer diameter of the bent portion 73 is smaller than an outer diameter of the second large diameter portion 70 (a portion of the second spring terminal 68, wherein the protruding part 69 protrudes from the portion).

Figure 6:
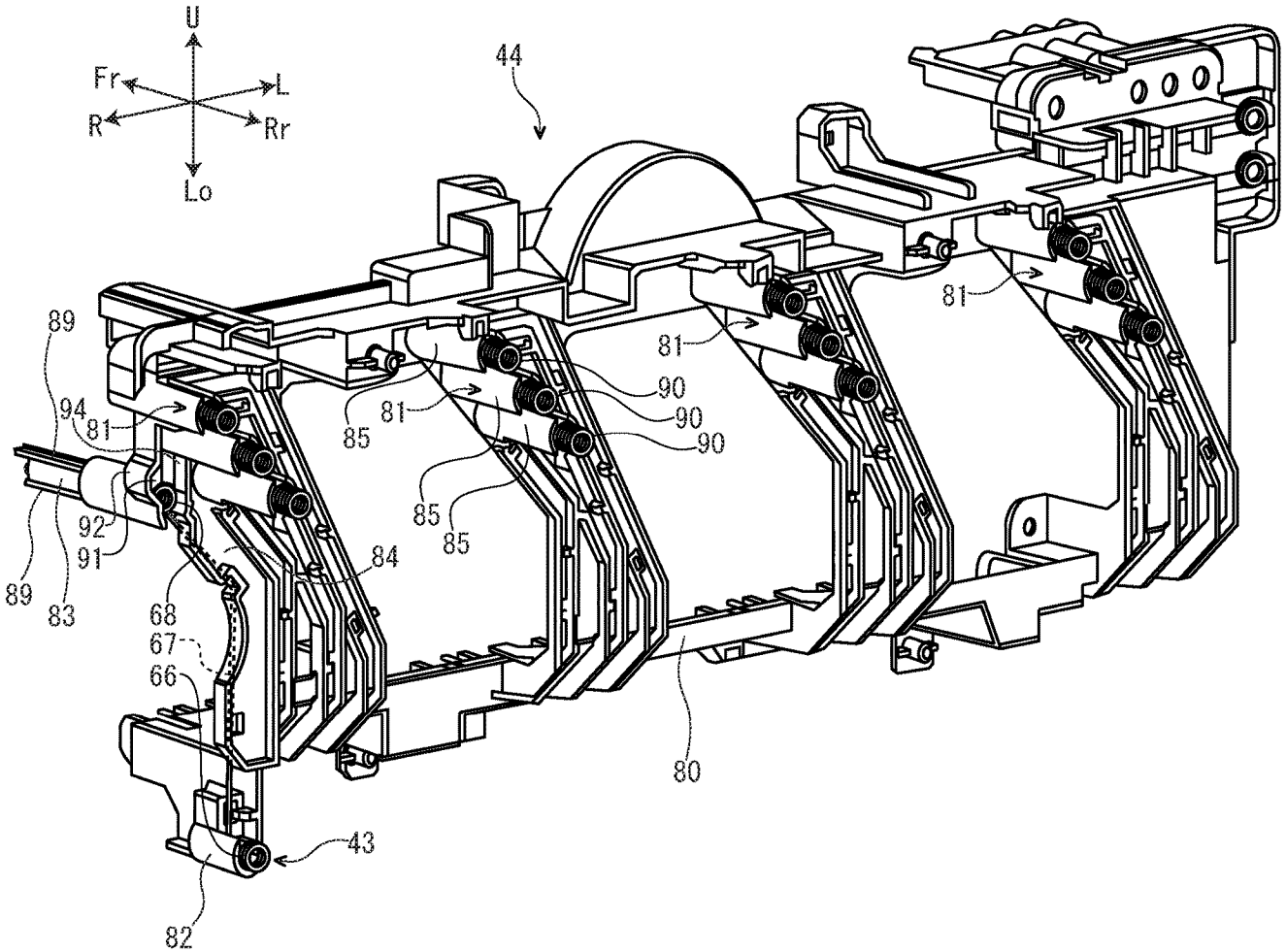
FIG. 6 is a perspective view showing the second connecting member and the second holding member, in the color printer according to the embodiment of the present invention.

The second holding member 44 is made of a resin having a high electrical insulation property, for example. As shown in FIG. 6, the second holding member 44 includes a second holding member main body 80 elongated along the left and right direction, four terminal holding parts 81 provided at an upper part of the second holding member main body 80, a board-side spring terminal housing 82 provided at a right lower corner of the second holding member main body 80, a cylindrical second housing 83 (housing) provided at a right end of the second holding member main body 80, and a locking part 91 arranged at a right upper side of a rear end of the second housing 83.

At the right end of the second holding member main body 80, a supporting plate part 84 is provided, and, at a front side of this supporting plate part 84, the second conductive wire 67 of the second connecting member 43 is arranged. Each terminal holding part 81 includes three terminal housing parts 85, and, in each terminal housing part 85, a terminal 90 is housed. In the board-side spring terminal housing 82, the board-side spring terminal 66 of the second connecting member 43 is housed.

Figure 7:
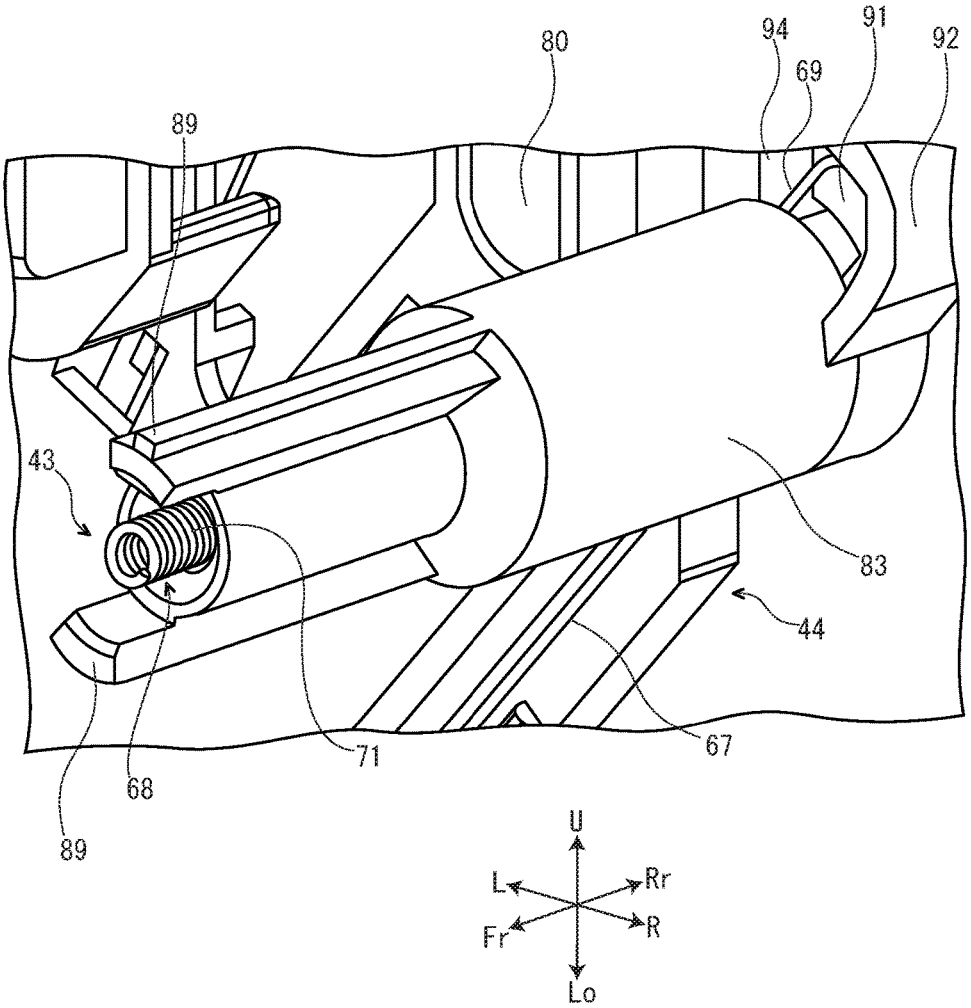
FIG. 7 is a perspective view showing the second spring terminal and its periphery seen from a front side, in the color printer according to the embodiment of the present invention.

As shown in FIG. 3, in the second housing 83, the second spring terminal 68 of the second connecting member 43 is housed. The second housing 83 includes a second large diameter portion insertion part 86, a second small diameter portion insertion part 87 provided at a front side of the second large diameter portion insertion part 86, and a connection part 88 arranged between the second large diameter portion insertion part 86 and the second small diameter portion insertion part 87. Into the second large diameter portion insertion part 86, the second large diameter portion 70 of the second spring terminal 68 is inserted. Into the second small diameter portion insertion part 87, the second small diameter portion 71 of the second spring terminal 68 is inserted. The second small diameter portion insertion part 87 has an inner diameter smaller than the second large diameter portion insertion part 86. The connection part 88 has an inner diameter gradually reduced toward the front side (to a side of the second small diameter portion insertion part 87). As shown in FIG. 7, at a front end of the second housing 83, a pair of upper and lower protrusions 89 are formed so as to protrude forward.

Figure 8:
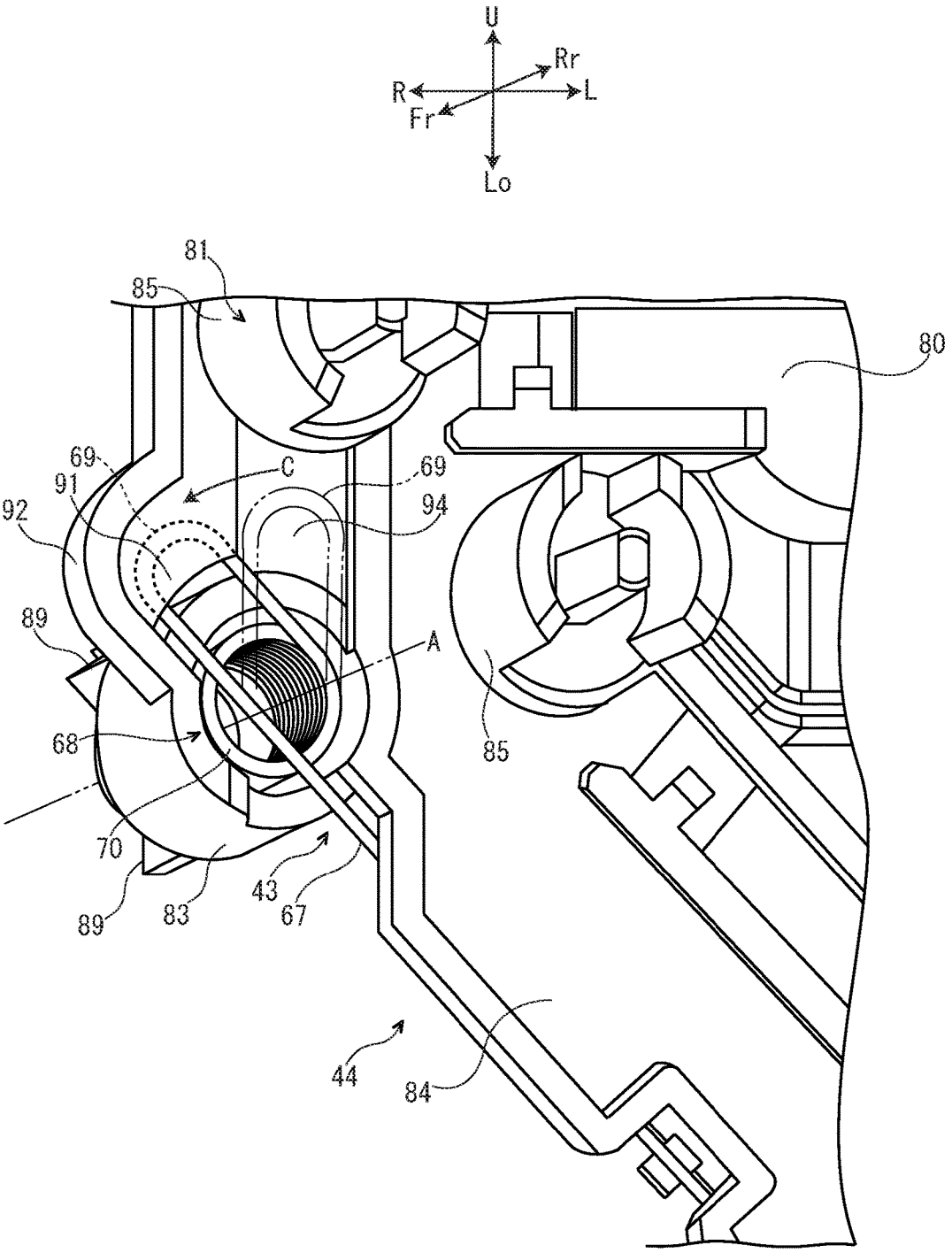
FIG. 8 is a perspective view showing the second spring terminal and its periphery seen from a rear side, in the color printer according to the embodiment of the present invention.

As shown in FIG. 8, the locking part 91 protrudes from the second housing 83 toward an outer diameter side. At a right side of the locking part 91, a coupling part 92 is provided and, by this coupling part 92, the second housing 83 and the locking part 91 are coupled. The locking part 91 is arranged integrally with the second housing 83 and the coupling part 92. At a left side of the locking part 91, an attachment/detachment aperture 94 is arranged so as to adjoin the locking part 91.

Figure 9:
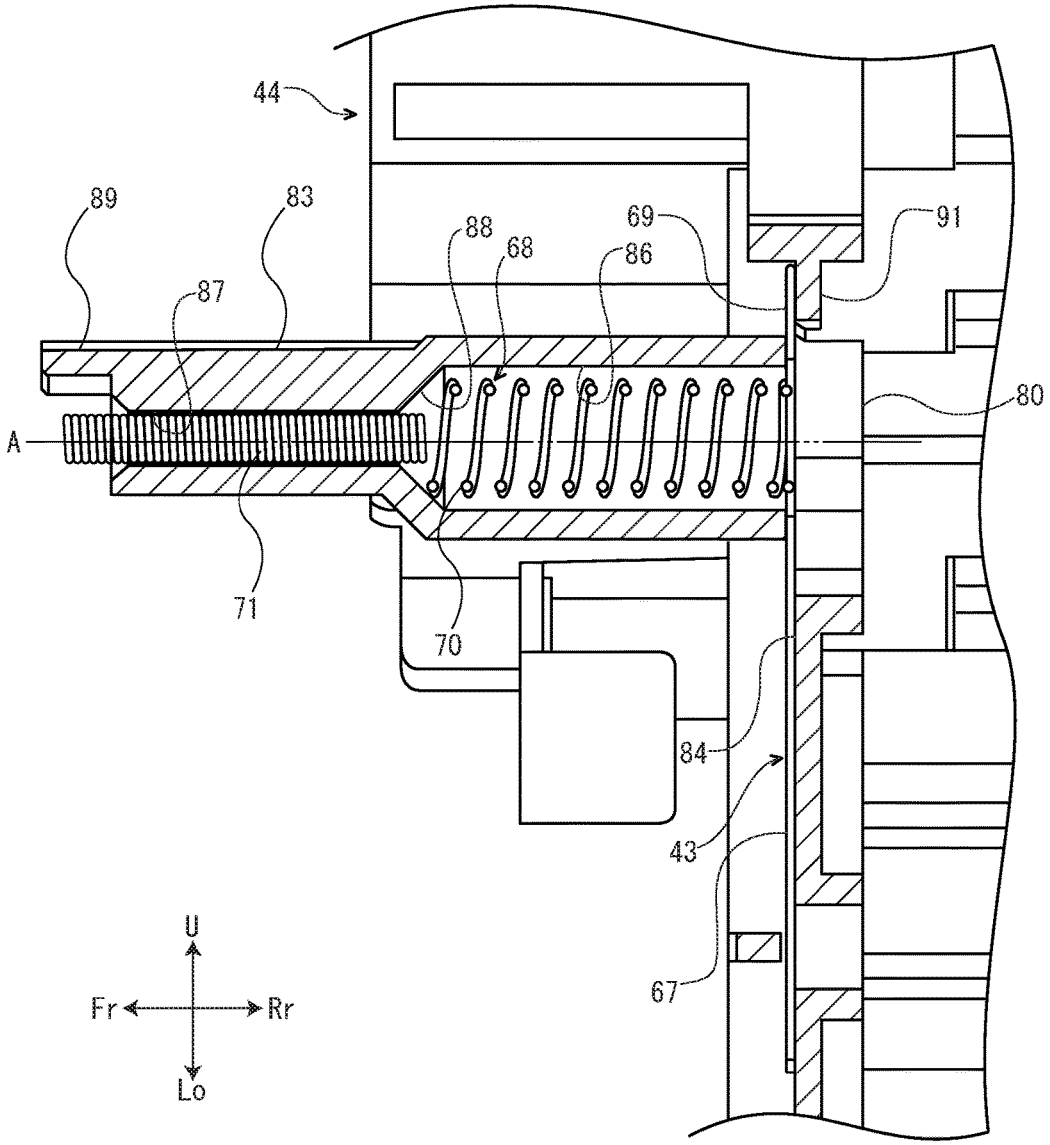
FIG. 9 is a sectional view showing the second spring terminal and its periphery, in the color printer according to the embodiment of the present invention.

As shown in FIG. 9, the locking part 91 is arranged at a rear side of the protruding part 69 of the second connecting member 43 to lock the protruding part 69. Thereby, movement of the second spring terminal 68 of the second connecting member 43 in the front and rear direction is restricted.

In the color printer 1 applying the above-mentioned configuration, an AC current supplied from the power supply board (not shown) to the high-voltage board is subjected to DC conversion and high-voltage conversion by the secondary transferring transformer 37 of the high-voltage board 36 so as to be converted into a high-voltage current. As indicated by an arrow I in FIG. 2, this high-voltage current is supplied from the secondary transferring transformer 37 of the high-voltage board 36 to the secondary transferring unit 18 through the first and second connecting members 40 and 43. Thus, the first and second connecting members 40 and 43 are arranged in a current path from the high-voltage board 36 to the secondary transferring unit 18.

Next, attaching and detaching manners of the second spring terminal 68 of the second connecting member 43 with respect to the second housing 83 of the second holding member 44 will be described.

When attaching the second spring terminal 68 to the second housing 83, the second spring terminal 68 is inserted into the second housing 83 and the protruding part 69 of the second connecting member 43 is located to the attachment/detachment aperture 94 of the second holding member 44. In such a state, the protruding part 69 is not locked by the locking part 91 of the second holding member 44. A positon (refer to a two-dot chain line in FIG. 8) of the protruding part 69 at this time is called as an "unlocked position".

Subsequently, as indicated by an arrow C in FIG. 8, the protruding part 69 is rotated around the axial center A of the second spring terminal 68. Thereby, the protruding part 69 is moved to a front side of the locking part 91 and locked by the locking part 91. A positon (refer to a dotted line in FIG. 8) of the protruding part 69 at this time is called as a "locked position".

On the other hand, When detaching the second spring terminal 68 from the second housing 83, the protruding part 69 is rotated around the axial center A of the second spring terminal 68 from the locked position to the unlocked position, and then, the second spring terminal 68 is extracted from the second housing 83.

In the present embodiment, as described above, the protruding part 69 is rotatable around the axial center A of the second spring terminal 68 between the locked position where the protruding part 69 is locked by the locking part 91 and an unlocked position where the protruding part 69 is not locked by the locking part 91. Therefore, it is possible to easily attach and detach the second spring terminal 68 with respect to the second housing 83 and to enhance maintainability of the color printer 1.

Further, the locking part 91 of the second holding member 44 locks the protruding part 69 of the second connecting member 43, and thereby, movement of the second spring terminal 68 in the front and rear direction is restricted. By applying such a configuration, it is possible to restrain coming-off of the second spring terminal 68 from the second hosing 83 and to restrain displacement of the second spring terminal 68 with respect to the second hosing 83 so as to correctly position the second spring terminal 68.

Further, under a configuration locking the protruding part 69 of the second connecting member 43 by the locking part 91 of the second holding member 44, the second connecting member 43 itself is also used for coming-off prevention from the second hosing 83. Accordingly, it is unnecessary to use a coming-off prevention member separate from the second connecting member 43 and the second holding member 44 in order to restrain coming-off of the second spring terminal 68 from the second hosing 83 and displacement of the second spring terminal 68 with respect to the second hosing 83. Therefore, it is possible to restrain an increase in the number of components and simplify a configuration of the color printer 1.

Further, the front end 71Fr of the second small diameter portion 71 of the second spring terminal 68 (one end of the second spring terminal 68) composes the high-voltage contact B together with the rear end 51Rr of the first small diameter portion 51 of the first spring terminal 48, and the protruding part 69 protrudes from the rear end 70Rr of the second large diameter portion 70 of the second spring terminal 68 (opposite end to one end of the second spring terminal 68) toward the outer diameter side. By applying this configuration, even if the front end 71Fr of the second small diameter portion 71 of the second spring terminal 68 is pressed by the rear end 51Rr of the first small diameter portion 51 of the first spring terminal 48, it is possible to effectively restrain coming-off of the second spring terminal 68 from the second hosing 83 and displacement of the second spring terminal 68 with respect to the second hosing 83.

Further, the second spring terminal 68 includes the second large diameter portion 70 composed of a compressible coil spring and the second small diameter portion 71 composed of a tightly wound coil spring and having the outer diameter smaller than the second large diameter portion 70. By applying this configuration, it is possible to downsize the second spring terminal 68 in comparison with a case that the second spring terminal 68 is composed only of the second large diameter portion 70. According to this, it is possible to downsize the second housing 83 housing the second spring terminal 68, and then, improve freedom of layout of components arranged in the periphery of the second housing 83.

Further, in the present embodiment, the secondary transferring unit 18 secondarily transferring the toner image on the intermediate transferring belt 6 to the sheet is used as a unit. By applying this configuration, it is possible to reliably supply a high-voltage current to the secondary transferring unit 18 from the high-voltage board 36.

In the present embodiment, a case that the secondary transferring unit 18 including the secondary transferring roller 19 is used as a unit was described. However, in another embodiment, an intermediate transferring unit including the intermediate transferring belt 6, an exposure unit including the exposure device 7, a photosensitive drum unit including the photosensitive drum 9, a developing unit including the developing device 11 or a fixing unit including the fixing device 20 or the like may be used as a unit. That is, every unit used for the image forming process on the sheet may be used as a unit.

In the present embodiment, a case that the front end 71Fr of the second small diameter portion 71 of the second spring terminal 68 (one end of the second spring terminal 68) composes the high-voltage contact B together with the rear end 51Rr of the first small diameter portion 51 of the first spring terminal 48 was described. However, in another embodiment, the front end 71Fr of the second small diameter portion 71 of the second spring terminal 68 (one end of the second spring terminal 68) may compose the high-voltage contact B together with the secondary transferring unit 18 or the high-voltage board 36.

In the present embodiment, a case that the configuration of the present invention is applied into the second connecting member 43 and the second holding member was described. However, in another embodiment, the configuration of the present invention may be applied into the first connecting member 40 and the first holding member 41.

In the present embodiment, a case that the first spring terminal 48 is composed of the first large diameter portion 50 composed of the compressible coil spring and the first small diameter portion 51 composed of the tightly wound coil spring was described. However, in another embodiment, the first spring terminal 48 may be composed only of a compressible coil spring.

In the present embodiment, a case that the second spring terminal 68 is composed of the second large diameter portion 70 composed of the compressible coil spring and the second small diameter portion 71 composed of the tightly wound coil spring was described. However, in another embodiment, the second spring terminal 68 may be composed only of a compressible coil spring.

In the present embodiment, the configuration of the present invention is applied to the color printer 1. In another embodiment, the configuration of the present invention may be applied to another image forming apparatus, such as a monochrome printer, a copying machine, a facsimile or a multifunction peripheral.

The invention claimed is:

1. An image forming apparatus comprising:

a unit used for an image forming process on a recording medium;

a high-voltage board configured to supply a high-voltage current to the unit;

a connecting member arranged in a current path from the high-voltage board to the unit; and a holding member configured to hold the connecting member, wherein the connecting member includes:

a spring terminal composed of a coil spring; and a protruding part protruding from the spring terminal to an outer diameter side, the holding member includes:

a housing configured to house the spring terminal; and a locking part arranged integrally with the housing, wherein the protruding part is rotatable around the spring terminal between a locked position where the protruding part is locked by the locking part and an unlocked position where the protruding part is not locked by the locking part, when the locking part locks the protruding part, movement of the spring terminal in an axial center direction is restricted.

2. The image forming apparatus according to claim 1, wherein one end of the spring terminal composes a high-voltage contact together with any one of the unit, the high-voltage board and another connecting member arranged in the current path from the high-voltage board to the unit, the protruding part protrudes from an opposite end to the one end of the spring terminal to the outer diameter side.

3. The image forming apparatus according to claim 1, wherein the spring terminal includes:

a large diameter portion composed of a compressible coil spring; and a small diameter portion composed of a tightly wound coil spring and having an outer diameter smaller than the large diameter portion.

4. The image forming apparatus according to claim 1, further comprising an image carrier to which a toner image is primarily transferred, wherein the unit is a secondary transferring unit configured to secondarily transfer the toner image on the image carrier to the recording medium.

5. An image forming apparatus comprising:

a unit used for an image forming process on a recording medium;

a high-voltage board configured to supply a high-voltage current to the unit;

a connecting member arranged in a current path from the high-voltage board to the unit; and a holding member configured to hold the connecting member, wherein the connecting member includes:

a spring terminal composed of a coil spring; and a protruding part protruding from the spring terminal to an outer diameter side, the holding member includes:

a housing configured to house the spring terminal; and a locking part arranged integrally with the housing, when the locking part locks the protruding part, movement of the spring terminal in an axial center direction is restricted, wherein the protruding part includes:

a first straight line portion extending from the spring terminal along a tangential direction of the spring terminal;

a bent portion bent in a semicircular shape from the first straight line portion; and a second straight line portion extending from the bent portion along a tangential direction of the bent portion.

6. The image forming apparatus according to claim 5, wherein the first straight line portion and the second straight line portion are arranged in parallel to each other, an outer diameter of the bent portion is smaller than an outer diameter of a portion of the spring terminal, the protruding part protruding from the portion.

7. The image forming apparatus according to claim 5, wherein one end of the spring terminal composes a high-voltage contact together with any one of the unit, the high-voltage board and another connecting member arranged in the current path from the high-voltage board to the unit, the protruding part protrudes from an opposite end to the one end of the spring terminal to the outer diameter side.

8. The image forming apparatus according to claim 5, wherein the spring terminal includes:

a large diameter portion composed of a compressible coil spring; and a small diameter portion composed of a tightly wound coil spring and having an outer diameter smaller than the large diameter portion.

9. The image forming apparatus according to claim 5, further comprising an image carrier to which a toner image is primarily transferred, wherein the unit is a secondary transferring unit configured to secondarily transfer the toner image on the image carrier to the recording medium.

10. An image forming apparatus comprising:

a unit used for an image forming process on a recording medium;

a high-voltage board configured to supply a high-voltage current to the unit;

a connecting member arranged in a current path from the high-voltage board to the unit; and a holding member configured to hold the connecting member, wherein the connecting member includes:

a spring terminal composed of a coil spring; and a protruding part protruding from the spring terminal to an outer diameter side, the holding member includes:

a housing configured to house the spring terminal; and a locking part arranged integrally with the housing, when the locking part locks the protruding part, movement of the spring terminal in an axial center direction is restricted, wherein the locking part protrudes from the housing to the outer diameter side.

11. The image forming apparatus according to claim 10, wherein one end of the spring terminal composes a high-voltage contact together with any one of the unit, the high-voltage board and another connecting member arranged in the current path from the high-voltage board to the unit, the protruding part protrudes from an opposite end to the one end of the spring terminal to the outer diameter side.

12. The image forming apparatus according to claim 10, wherein the spring terminal includes:

a large diameter portion composed of a compressible coil spring; and a small diameter portion composed of a tightly wound coil spring and having an outer diameter smaller than the large diameter portion.

13. The image forming apparatus according to claim 10, further comprising an image carrier to which a toner image is primarily transferred, wherein the unit is a secondary transferring unit configured to secondarily transfer the toner image on the image carrier to the recording medium.

* * * * *